United States Patent [19]

Shine

[11] Patent Number: 4,897,961

[45] Date of Patent: Feb. 6, 1990

[54] RELEASABLE MOUNT FOR WINDOW GRILLES

[76] Inventor: Jerry P. Shine, 10451 Isleworth Ave., San Diego, Calif. 92926

[21] Appl. No.: 258,600

[22] Filed: Oct. 17, 1988

[51] Int. Cl.[4] ..... E05B 65/10

[52] U.S. Cl. ..... 49/141; 49/357; 49/379; 49/395

[58] Field of Search ..... 49/141, 357, 394, 395, 49/379

[56] References Cited

U.S. PATENT DOCUMENTS

| | | | |
|---|---|---|---|
| 3,178,213 | 4/1965 | Nelson | 292/18 |
| 3,600,021 | 8/1971 | Hawkins | 292/167 |
| 3,921,334 | 11/1975 | Black, Sr. | 49/141 X |
| 4,019,281 | 4/1977 | Weiler | 49/141 X |
| 4,055,360 | 10/1977 | Russi | 292/228 |
| 4,087,121 | 5/1978 | Davis | 292/139 |
| 4,127,966 | 12/1978 | Schmidt | 49/141 |
| 4,208,837 | 6/1980 | Black, Sr. et al. | 49/56 |
| 4,263,747 | 4/1981 | Coltrin et al. | 49/56 |

*Primary Examiner*—Philip C. Kannan

*Attorney, Agent, or Firm*—Owen, Wickersham & Erickson

[57] ABSTRACT

A releasable mount for window grilles and the like. A wall-mounted portion is attached to a wall near the window and includes a fixed housing with a latch member having an opening therethrough and a trigger pin mounted for movement from a cocked, extended position to a release position. A grille-mounted portion is rigidly attached to the grille and includes a latch pin having a cavity with a catch assembly inserted into the fixed housing and partly through the opening in the latch member. The catch assembly expands to a catch position upon contact of the latch pin with the trigger pin. Then the catch assembly catches on the latch member and prevents the latch pin from being withdrawn from the fixed housing. The trigger pin remains biased in the cocked position, and keeps the catch assembly in its expanded position. However, when the trigger pin is moved to the release position, the catch assembly may retract and enable the latch pin to be withdrawn and separate from the fixed housing. A remote actuating assembly for actuating the releasable mount may include a suitable cable connected at one end to the trigger pin and extending through the wall and into the building. The cable preferably connects with a kick plate assembly, mounted on the wall inside the building, which in response to a pushing force imparts a pulling force on the cable on the kick plate.

16 Claims, 6 Drawing Sheets

RELEASABLE MOUNT FOR WINDOW GRILLES

This invention relates to releasable mounts for mounting window grilles or other security covers for covering a window or other opening of a building, and, more particularly, to a releasable mount that may be operated from inside the building with minimal effort.

BACKGROUND OF THE INVENTION

Metal grilles or bars adapted to cover windows or other openings in buildings have gained substantial popularity, particularly in recent years. Such metal grilles are used for their decorative effect and may have elaborate ornamental designs. However, at least in recent times, especially when on the ground floor, window grilles have been used for security purposes, that is, to prevent unauthorized entry into a building through its windows or other openings.

Window grilles have been permanently fixed over the particular openings, however, such permanent mounting produces many undesirable results. Most importantly, permanently fixed window grilles not only prevent unauthorized entry, but also prevent the occupants of the building from exiting the building through the covered window in an emergency situation. Also permanently fixed window grilles make it difficult to reach the covered window from the outside for repairs or cleaning.

Due to the often disastrous consequences of permanently fixing grilles over windows, a number of releasing means have been developed to enable a person to release a window grille or the like from inside a building having such grille-covered windows. The earliest releasable grilles were mounted along one edge on hinged mounts with the other edge held securely in place with a lockable mount, adapted to be locked with a key or combination lock.

These locked window grilles proved inadequate for several reasons. First, where key locks were used, the keys were often misplaced and could not be found in an emergency situation. Second, where combination locks were used, the combinations were easily forgotten or lost. In either type of locking window grille, the locks could not be operated by children, either because they could not be reached, or because they required skill beyond the capability of the child.

Other releasing mechanisms were adapted to be operated from inside the building or enclosure. These mounting devices generally used a plurality of releasable mounts and a plurality of hinged mounts adapted so that when the releasable mounts were released, the grille could swing open on the hinged mounts. The releasing mechanisms of the releasable mounts were located outside the building in an armored enclosure and were operated by means of a cable or chain that could be pulled by someone inside of the building.

These prior releasing mounts, while an improvement over the permanently fixed, or padlocked window grilles, still suffered from requiring a relatively large force to operate. This excessive force problem generally arose because there was substantial frictional resistance to the releasing movement in these old release mechanisms.

In some cities, the use of window grilles is regulated, due to the substantial hazards that they pose with regard to emergency exit. Not only are permanently fixed grilles and certain specific release mechanisms prohibited, but some regulations set out broad standards that must be met by all release mechanisms. One such regulation is that the release mechanism must not require both hands for actuation. Also, a minimum actuating force has been established in some communities, and will likely be established in others.

It is therefore an object of the invention to provide a releasable mount for window grilles, or other security or ornamental coverings, that can be released from the inside of the building or enclosure with minimal effort and without special training or knowledge.

Another object of the invention is to provide a releasable mount for mounting security grilles and the like, that has few moving parts, and is not susceptible to release from outside of the building on which they are used.

These and other objects, advantages, and features of the invention will be apparent from the following summary of the invention and description of preferred embodiments, considered along with the accompanying drawings.

SUMMARY OF THE INVENTION

According to the invention a window grille or other security covering is mounted over a window or other opening in a building on at least one releasable mount so that the grille can be opened from inside the building with minimal effort. In one preferred form of the invention, suitable for most window covering applications, the grille is mounted on four mounts, two along one edge of the grille being releasable, and two on the opposite edge being hinged so that when the releasable mounts are released, the grille may swing open to allow emergency egress through the particular opening. The two releasable mounts are also adapted so that they release simultaneously. In other forms, the grille may be mounted on only one releasable mount, or even all releasable mounts.

A releasable mount according to the invention includes a fixed or wall-mounted portion that is adapted to attach rigidly to the wall of a building adjacent to a window or other opening to be covered, and a grille carried portion that is attached to the grille and is adapted to releasably connect with the fixed portion in a connected position. From the connected position, the mount is released with a remote actuating mechanism through which a small releasing force is applied to the mount.

The fixed portion includes a fixed or wall housing having a base end adapted to attach to a wall and an open end. A latch member and a trigger pin are mounted within the housing. The trigger pin is movably mounted generally for movement between a release and a cocked position, between the base end of the housing and the latch member. A biasing means, such as a suitable spring, biases the trigger pin in its cocked position, which is generally away from the wall on which the fixed portion is secured.

The grille-mounted portion of the releasable mount includes a latch pin that is adapted to be inserted to a latching position through the open end of the fixed housing, and an opening in the latch member. The latch pin also includes a cavity in which is mounted butterfly-like catch means adapted to catch onto the latch member of the fixed housing when the latch pin is inserted to the latching position.

The catch means is adapted to move from a retracted position, with the catch means being substantially contained within the cavity in the body of the latch pin, to an extended, catching position. With the catch means in the retracted position, the latch pin may be easily inserted through the latch member opening to the latching position. However, the catch means is adapted to expand or spread after being inserted past the latch member so as to catch on the latch member and prevent the latch pin from being removed.

The catch means according to the invention expands upon insertion of the latch pin by contact with the trigger pin mounted inside the fixed housing and biased in the cocked position. In a preferred form of the invention, the catch means includes a butterfly assembly comprising two catch members, both pivoted about a common axis extending substantially transversely through the longitudinal centerline of the latch pin. As the latch pin is inserted to the latching position, the trigger pin extends through an opening in the end of the latch pin into the cavity and between the two catch members, causing them to pivot about their common rotational axis, and spreading or expanding them into the catch position. Once in the catch position, the trigger pin also prevents the two catch members from closing. With the catch members expanded into the catch position, the catch members "catch" on the latch member and prevent the latch pin from being withdrawn from the fixed housing through the latch member opening, and thus prevents the mount from releasing.

To release the mount, the trigger pin is moved to its release position. In the release position, the trigger pin allows the catch members to retract sufficiently so that the latch pin, on which the catch members are mounted, may be withdrawn from the fixed housing.

The butterfly assembly also preferably includes catch member biasing means for normally biasing the catch members in their retracted position. By biasing the catch members in their retracted position, the latch pin, when not in the latching position, remains at all times ready for insertion into the fixed housing, and there is no need to manually retract the catch members to prepare the latch pin for insertion.

The grille-mounted portion of the mounting device also preferably includes a latch pin housing, including at least a base plate extending substantially transversely from the latch pin. Preferably, the latch pin housing also includes an overlap portion that is adapted to overlap with the fixed housing when the latch pin is inserted to the latch position. The latch pin housing combines with the fixed housing to securely house the latch pin, catch means, and trigger pin so that they cannot be reached and tampered with. The two housings also help seal the inner mechanisms of the releasable mount when the latch pin is inserted to the latch position, to prevent moisture or other potentially damaging foreign material from reaching the housed parts.

Preferably, a separation biasing means, such as a suitable spring, biases the latch pin and the fixed housing away from each other when the latch pin is in the latched position. The energy stored in the separation biasing means causes the latch pin, and the grille on which it is mounted, to spring away from the fixed housing when the catch means are allowed to retract, and the mount thereby released. Thus, when released, the mounts according to the invention enable the window grille to swing open, allowing egress through the formerly covered window.

The mount also includes a remote actuating assembly that connects to the trigger pin of the releasable mount. The remote actuating assembly extends through the wall on which the fixed housing is mounted, and into the building where it can easily be reached. Generally, each grille will be mounted on at least two releasable mounts, and where multiple releasable mounts are used, the remote actuating means preferably connects to the trigger pin of each mount, and enables simultaneous release of the mounts.

The preferred remote actuating assembly includes a suitable actuating cable connected at one end to the trigger pin of the releasable mount. At its other end, which extends inside the building, the cable is connected to a pivoting kick plate of a kick plate assembly. The kick plate assembly is preferably mounted low on the inside surface of the wall having the covered window, and directly below the window. The kick plate is adapted for imparting a pulling movement on the cable, when the kick plate is lightly pushed. This movement pulls the trigger pin from its cocked position to its release, thereby enabling the catch members to retract and enabling the latch pin to separate from the fixed housing.

DESCRIPTION OF THE PREFERRED EMBODIMENTS

Figure 1:
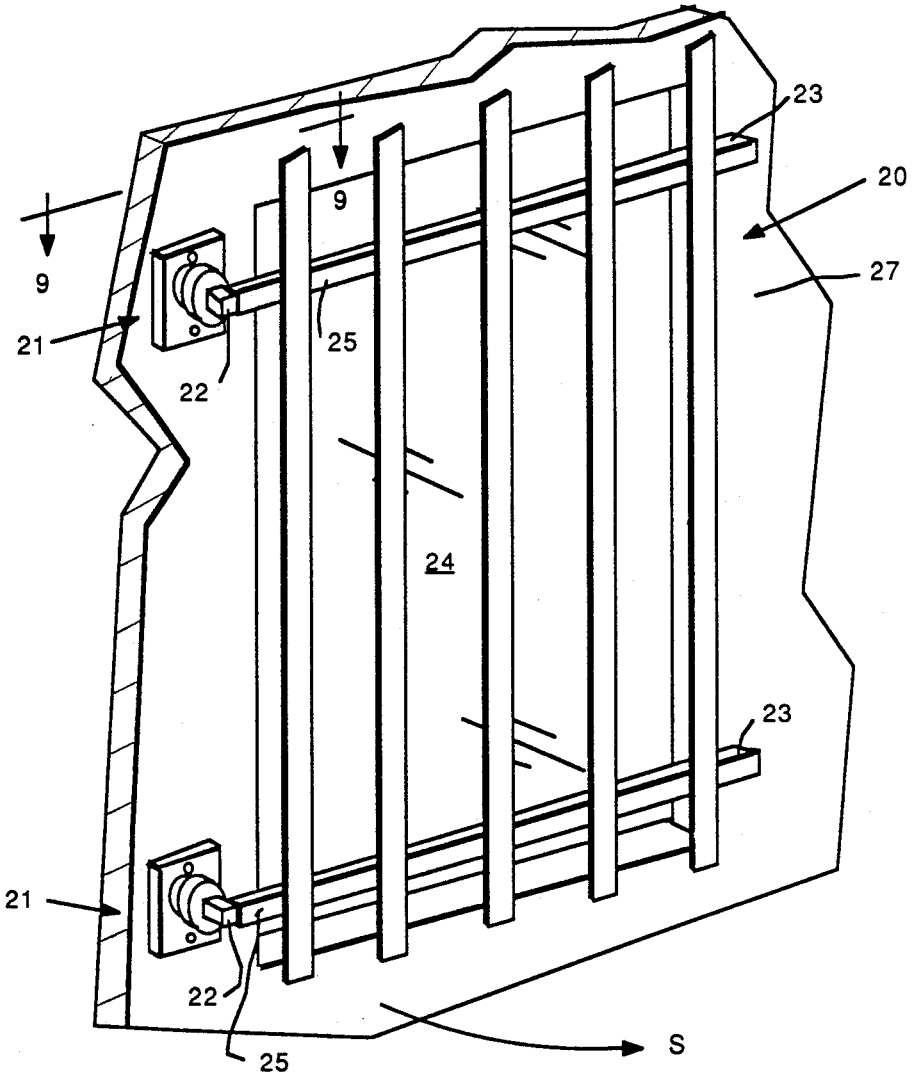
FIG. 1 is a fragmentary view in perspective of a window grille mounted on two releasable mounts and embodying the principles of the invention.

FIG. 1 shows a window grille 20 mounted upon two releasable mounts 21 embodying the principles of the invention. In addition to the two releasable mounts 21, the window grille 20 is also mounted on two hinged mounts 23. The hinged mounts 23 are adapted to pivot about a substantially vertical axis to allow the grille to swing open in the direction indicated by an arrow S, when the two releasable mounts 21 are released. Once the grille 20 is released, a window 24 is available for emergency exit.

Although the releasable mounts 21, embodying the principles of the invention, are shown in FIG. 1 as used with a window grille 20, the releasable mounts 21 may also be used with other types of coverings for covering other types of openings through the walls of a building or other enclosure. The window grille example is used for convenience of description and should not be deemed as limiting the application of the disclosed releasable mounts.

Figure 2:
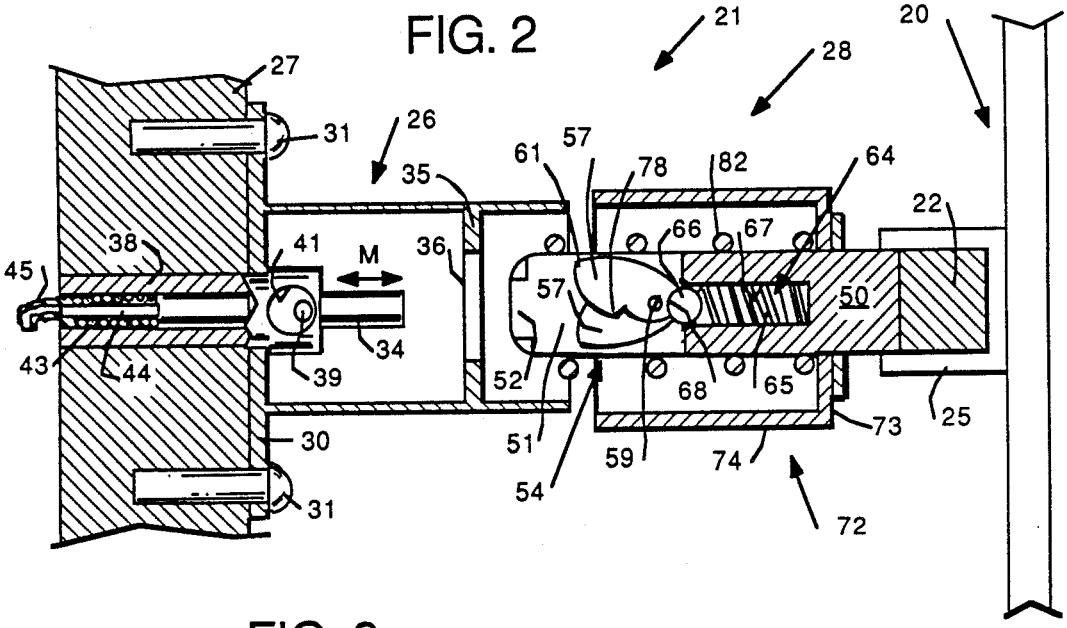
FIG. 2 is a view in longitudinal cross-section of one of the releasable window grille mounts of FIG. 1, drawn on a larger scale.
Figure 3:
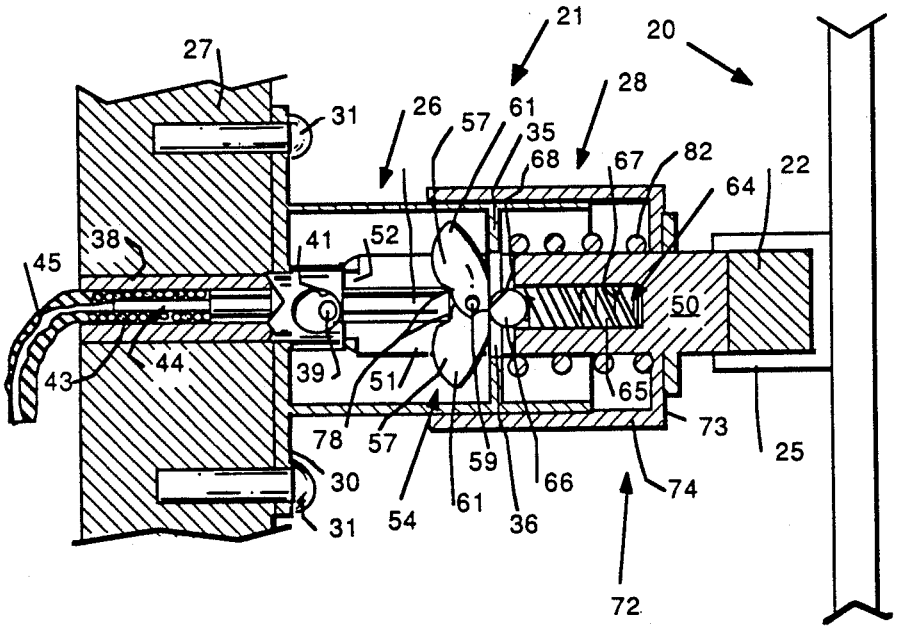
FIG. 3 is a view in longitudinal cross-section similar to FIG. 2, except showing the mounts in the latching position.
Figure 4:
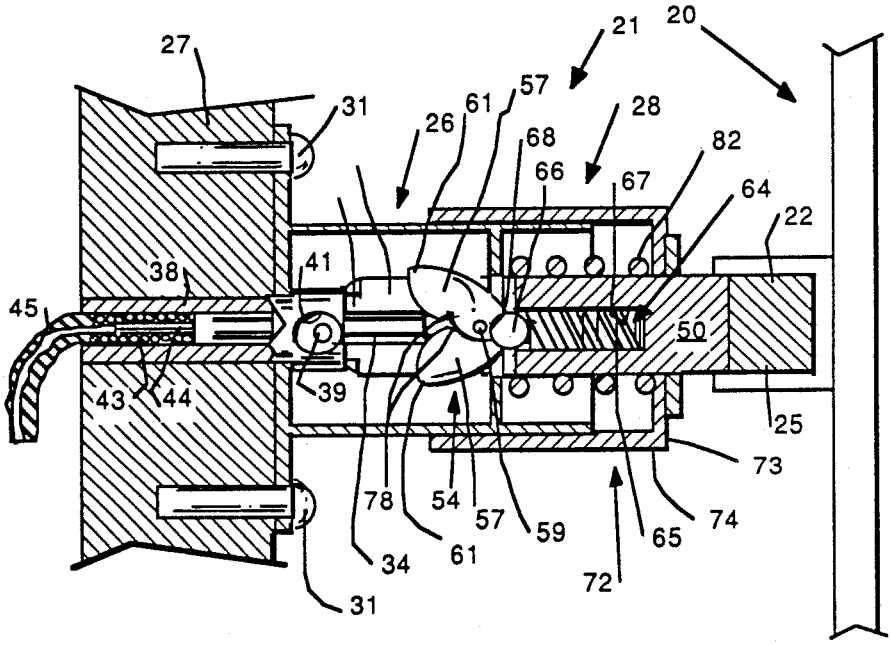
FIG. 4 is a view in longitudinal cross-section similar to FIGS. 2 and 3, except with the trigger pin in the release position, allowing the mount to release.

FIGS. 2, 3, and 4 illustrate one of the releasable mounts 21 shown in FIG. 1, in the separated, latched, and releasing positions, respectively.

In the illustrated preferred form of the invention, the releasable mount 21 includes a fixed or wall housing 26, which is adapted to be mounted on a wall 27 adjacent the opening to be covered. The releasable mount also includes a grille mounted portion 28 rigidly connected to a grille 20.

The fixed housing 26 includes a base end 30 through which suitable fasteners 31 may pass into the wall 27 to secure the housing 26 to the wall 27. The housing 26 houses a trigger pin 34 and a latch member 35, the latch member 35 in this case having an aperture or opening 36 therethrough. The trigger pin 34 is mounted for movement within a sleeve 38 in a direction indicated by an arrow M in FIG. 2, from a fully released position shown in FIG. 2 to an extended cocked position (shown in FIG. 3). An intermediate position is shown in FIG. 4. The extent of the trigger pin 34 movement is limited by a cross pin 39 that extends transversely through the trigger pin 34 in position to catch on a stop 41 in the sleeve 38. In this form of the invention, the trigger pin 34 and the sleeve 38 also both extend through the wall 27 from the fixed housing 26 through to the inside surface of the wall 27. A spring 43, mounted within the sleeve 38, biases the trigger pin 34 toward the cocked position (FIG. 3). An actuating cable 44 is connected to the trigger pin 34, and extends through the sleeve 38 and through a cable conduit 45 to a remote actuating means described hereinafter with reference to FIGS. 5 through 9.

The grille-mounted portion 28 of the releasable mount 21 includes a latch pin 50 that is rigidly connected as by welding (or other suitable means) to a suitable length of square tubing 22, which is then inserted into the portion 25 of the grille 20 and also connected by some suitable means. For example, the latch pin 50 may include a cavity 51 in which a catch means 54 is mounted. As shown in FIGS. 2, 3, and 4, the latch pin 50 is adapted to be inserted through the aperture 36 in the latch member 35, to a fully inserted latched position with the trigger pin 34 extending into the cavity 51 through an opening 52 in the end of the latch pin.

The catch means 54 in the illustrated form of the invention comprises a butterfly assembly having two butterfly or catch members 57. The catch members 57 are mounted on a pivot pin 59 that extends substantially transversely through the longitudinal centerline of the catch members 57. The catch members 57 are adapted to move from a retracted position shown in FIG. 2, to an expanded or spread position as shown in FIG. 3. In the retracted position, shown in FIG. 2, the catch members 57 are entirely contained within the cavity 51 of the latch pin 50, but are preferably parted somewhat at their rounded ends 61.

In the preferred form of the invention shown in the figures, the catch means 54 also includes biasing means 64 for biasing the catch members 57 toward the retracted position. The biasing means 64 includes a spring 65 and a ball 66 mounted in a cavity 67 of the latch pin 50. The ball 66 is adapted to press against a curved portion 68 of each of the catch members 57 when the grille 20 is opened, thereby keeping the catch means 57 together inside the cavity 51 of the latch pin 50, so that the catch means 57 will not obstruct the normal closing of the window grille 20 by falling out or open and crashing into the latch member 35.

The illustrated form of the invention also preferably includes a latch pin housing 72 with an end plate 73 and a clyindrical portion 74. As best illustrated in FIG. 3, the latch pin housing 72 cooperates with the fixed housing 26 to protect the latching mechanisms, such as the trigger pin 34 and catch means 54, from tampering, and also from foreign material such as dust or water that could damage the mechanisms.

As shown in FIG. 3, the latch pin 50 is adapted to be fully inserted to a latched position. In the latched position the catch members 57 are in their extended position and contact the latch member 35. This contact between the catch members 57 and the latch member 35 prevents the latch pin 50 from being withdrawn from the fixed housing 26.

The butterfly-like catch members 57 are spread or extended by the trigger pin 34, which contacts the catch members 57 as the latch pin 50 is inserted to the latched position. When the latch pin 50 is in the fully inserted latching position, the trigger pin 34, being biased in its extended, cocked position, extends between a pair of portions 78 of the catch members 57. Thus, when the latch pin 50 is in the fully inserted position, the trigger pin 34 prevents the catch members 57 from closing to their retracted position.

From the latched position shown in FIG. 3, the latch pin 50 may only be withdrawn from the fixed housing 26 by moving the trigger pin 34 to its release position shown in FIG. 4. In the release position, the trigger pin 34 does not extend between the jaws 78 of the catch members 57, and the catch members 57 are free to collapse to the retracted position (shown in FIG. 2), which allows the latch pin 50 to be withdrawn from the fixed housing 26. As best illustrated in FIG. 4, very little movement of the trigger pin 34 is required to release the mount 21. For example, release may require less that one-eighth of an inch of trigger pin movement. Also, there is very little resistance to movement of the trigger pin 34 to the release position, only the slight frictional force of the jaw 78 and the biasing force of the spring 43. Thus, the mounts 21 embodying the principles of the invention may be separated easily, with minimal effort, even by children.

In the illustrated form of the invention, a separating spring 82 is positioned in the latch pin housing 72 and is adapted to be compressed somewhat when the latch pin 50 is in the fully inserted, latched position. The separating spring 82 assists the latch pin 50 and the latch pin housing 72 to separate from the fixed housing 26 when the trigger pin 34 is moved to the release position. Preferably, the strength of the separating spring 82 and the amount of compression in the latched position are selected so that the latch pin 50 and the grille 20 on which it is mounted separate from the fixed housing 26 only a relatively short distance when the mount 21 is released. A short separating distance enables a person to use the grille 20 to steady himself as he exits through the window.

Figure 5:
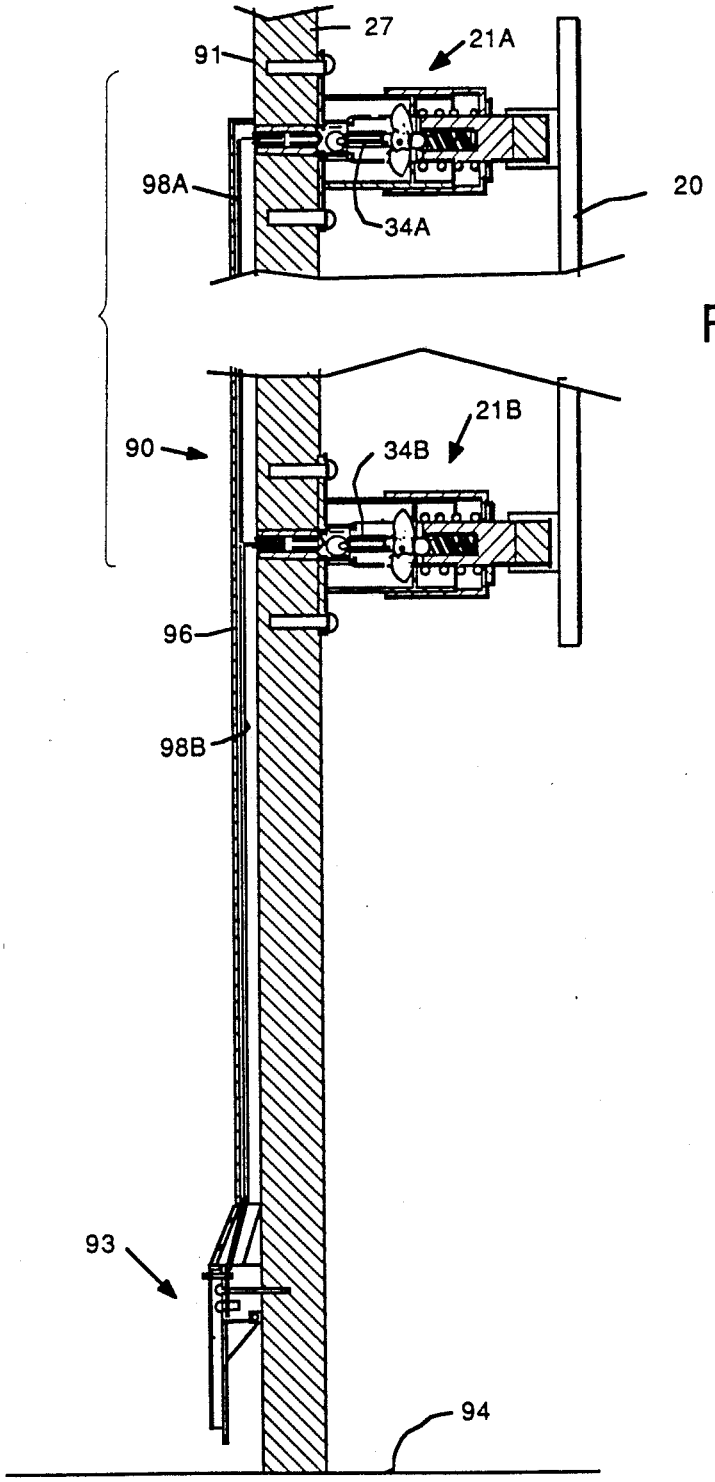
FIG. 5 is a view in section of two mounts similar to those shown in FIGS. 1, 2, 3, and 4, the mounts being shown in a closed and attached to the kick plate.

FIG. 5 shows two releasable window grille mounts 21 embodying the principles of the invention, an upper mount 21*a*, and a lower mount 21*b*, both in the latched position and holding a grille 20 in a normal closed position. The two mounts 21*a* and 21*b* are connected to the wall 27 adjacent a window 24 or other opening (not shown) over which the grille 20 is positioned.

FIG. 5 also shows a remote actuating means 90 mounted on the inside surface 91 of the wall 27. This preferred remote actuating means 90 includes a kick plate assembly 93 mounted low on the wall 27, near the floor 94 so that it can be easily reached by children. A cable housing 96 runs up the wall 27 from the kick plate means 93 to the level of the upper mount 21*a*. Two separate actuating cables 98 are connected to the kick plate assembly 93, and run inside the cable housing 96. One cable 98*a* runs from the kick-plate assembly 93 to the upper mount 21*a*, and another cable 98*b* extends from the kick plate assembly 93 to the lower mount 21*b*. One actuating cable 98*a* connects at its upper end to a trigger pin 34*a* of the releasable mount 21*a*, and the other cable 98*b* connects to the trigger pin 34*b* of the lower mount 21*b*.

In the preferred form of the invention, the cables 98*a* and 98*b* are themselves housed in a suitable conduit, such as the conduit 45 shown in FIGS. 2, 3 and 4. Also, although the term cable has been used, it should be understood that any relatively strong and flexible single strand wire or line may be used as an alternative to a braided cable or cord.

Figure 6:
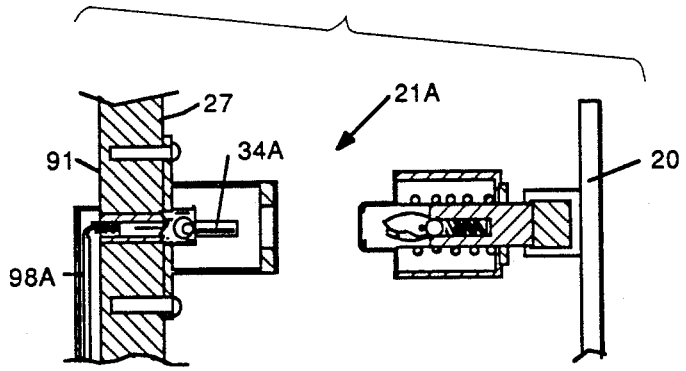
FIG. 6 is a view in section similar to FIG. 5, but with the mounts released and the kick plate in the released position.

The remote actuating means 90 is adapted to release the two mounts 21*a* and 21*b* simultaneously, as shown in FIG. 6. To release the two mounts 21*a* and 21*b*, a kick plate 103 of the kick plate assembly 93 is pushed toward the wall 27 to a release position. The movement of the kick plate 103 to the release position pulls both of the cables 98*a* and 98*b* to move the two trigger pins 34*a* and 34*b* to their respective release position, which causes mounts 21*a* and 21*b* to release, as shown.

Figure 7:
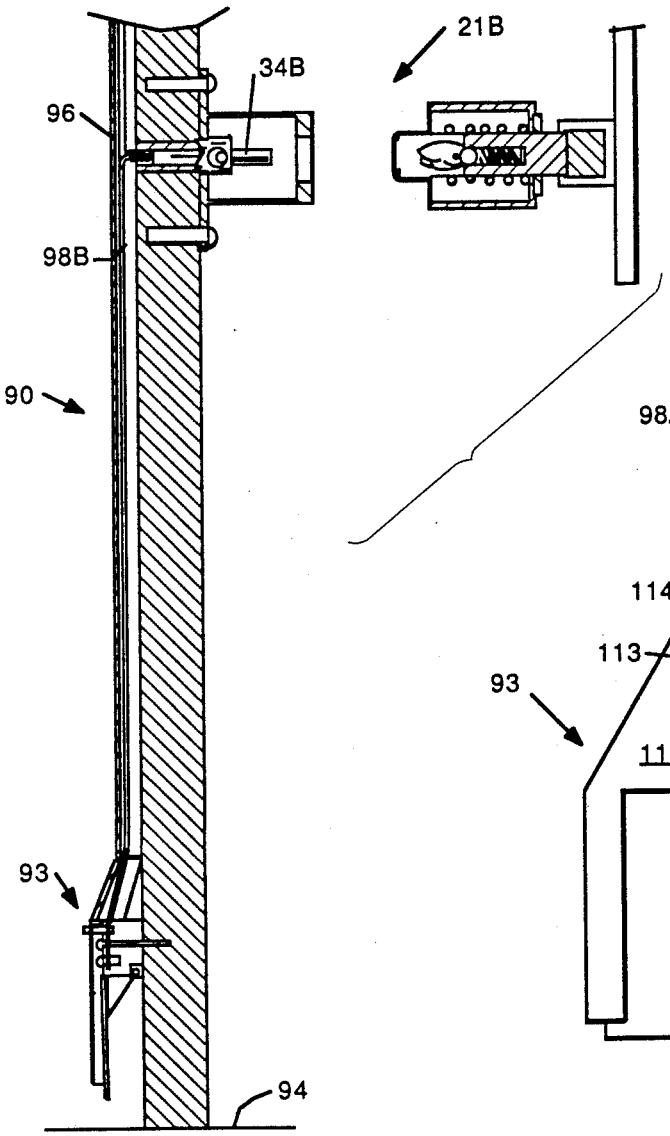
FIG. 7 is an enlarged view in flat elevation of a preferred kick plate assembly of FIGS. 5 and 6, embodying the principles of the invention.
Figure 7:
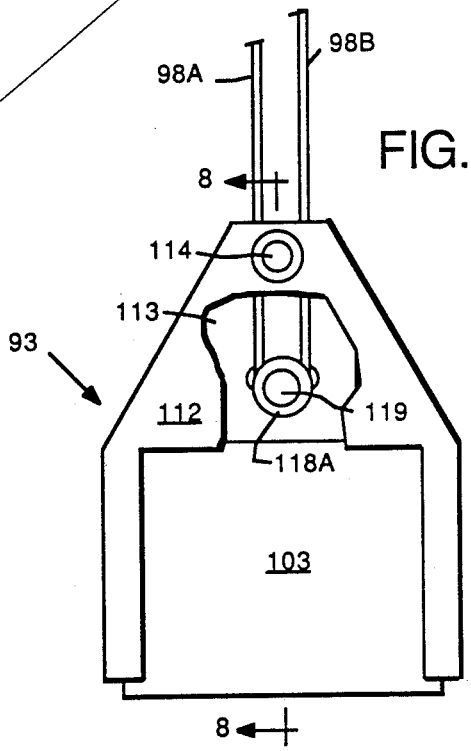
Figure 8:
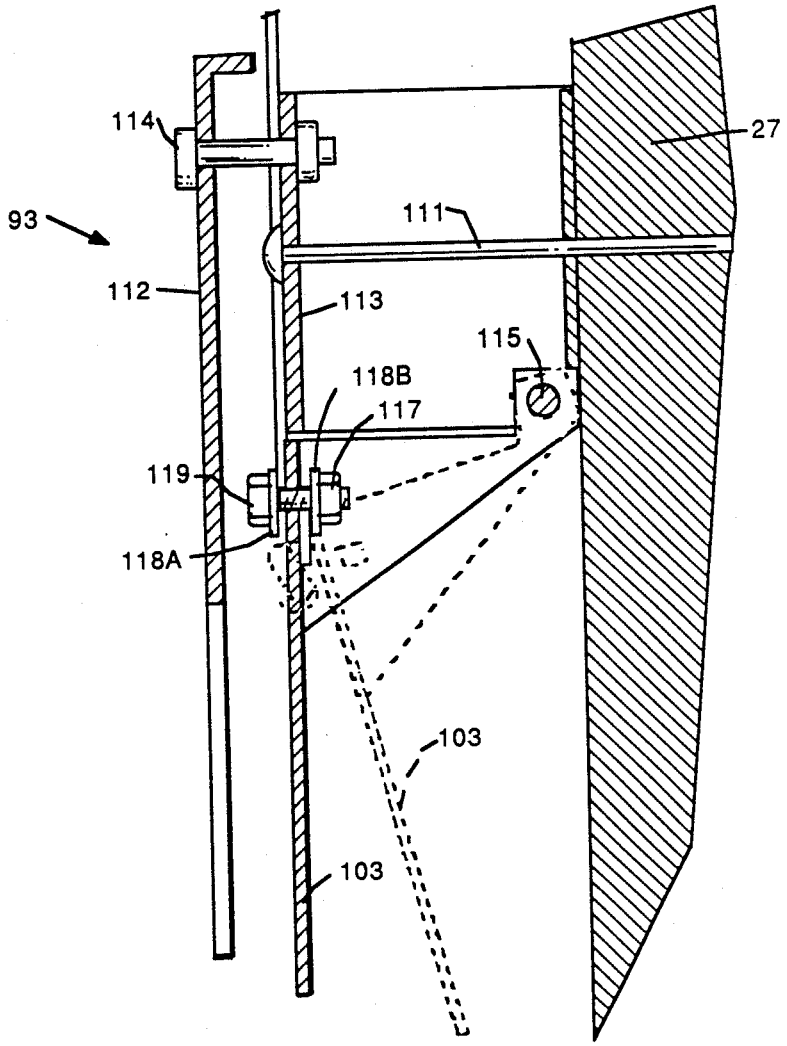
FIG. 8 is a further enlarged view in section of the kick plate of FIG. 7 taken along line 8-8 in FIG. 7.

FIGS. 7 and 8 illustrate one preferred form of the kick plate assembly 93. The kick plate assembly 93 includes a kick plate housing 112 and a mount 113 that are attached to each other by suitable means, such as a screw 114. A screw 111 attaches the mount 113 to the wall 27. The kick plate 103 is pivoted to the mount 113 by a suitable pivot or hinge means 115, and is movable from a substantially vertical latched position to a release position shown in phantom in FIG. 8. Suitable connecting means, such as a cable screw 117 going through openings 103*a* and 103*b* of the kick plate 103, cooperate with a pair of washers 118*a* and 118*b* and a nut 119 clamps the cables 98*a* and 98*b* to the kick plate 103, so that when the kick plate 103 is pushed from the vertical position to the release position, the cables 98*a* and 98*b* are each pulled downward a short distance, which, as shown in FIG. 6, is sufficient to release the mounts 21*a* and 21*b*.

Figure 9:
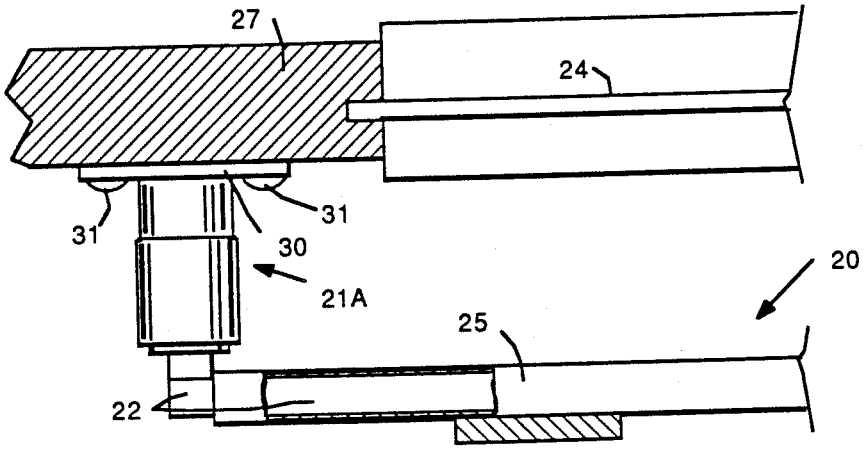
FIG. 9 is a view in section of the releasably mounted window grille of FIG. 1, taken along line 9-9 in FIG. 1 and enlarged.

FIG. 9 illustrates in more detail one preferred connection between the grille 20, the releasable mount 21, and the grille-mounted portion 28 of the releasable mount 21. In this form of the invention, the grille-mounted portion 28 is rigidly connected to an extension 22 that extends substantially in the plane of the grille 20.

The grille 20 includes a receptacle sleeve 25 for receiving the extension.

The above described preferred embodiments are intended to illustrate the principles of the invention, but not to limit the scope of the invention. Various other embodiments and modifications to these preferred embodiments may be made by those skilled in the art, without departing from the scope of the following claims.

What is claimed is:

1. A releasable mount for mounting a window grille over a window, the mount comprising:

a fixed housing having a base end adapted for rigid attachment to a wall adjacent to the window, and an open end directed outwardly away from the wall, a latch member mounted inside the fixed housing, the latch member having an opening therethrough, a latch pin adapted to be rigidly connected to the window grille, and adapted to be received through the open end of the fixed housing and the opening in the latch member, to a latched position, the grille being in the desired mounted position over the window when the latch pin is in the latched position, catch means mounted in a cavity inside the latch pin and being adapted for movement between a retracted position and an expanded position, for preventing the latch pin from being withdrawn from the latched position when in the expanded position, and for enabling the latch pin to be inserted and withdrawn from the fixed housing when in the retracted position, a trigger pin mounted in the fixed housing with one end extending between the base end of the fixed housing and the latch member, the trigger pin being adapted for movement between a cocked position, and a release position relatively further away from the latch member, and being biased by a biasing means in the cocked position, the trigger pin, when in the cocked position, being adapted to contact the catch means mounted on the latch pin when the latch pin is inserted into the fixed housing to the latched position, said contact causing the catch means to expand to the expanded position, and, the trigger pin, when in the release position, being adapted to enable the catch means to retract to the retracted position so that the latch pin may be withdrawn from the fixed housing, and remote actuating means connected to the trigger pin for enabling a person inside the building to move the trigger pin from the cocked position to the release position, thereby enabling the latch pin to be withdrawn from the latched position.

2. The releasable mount of claim 1 wherein the catch means includes retraction biasing means for biasing the catch means toward the retracted position when the latch is not in the latched position.

3. The releasable mount of claim 2 wherein the catch means comprises:

a first catch member mounted in the cavity of the latch pin for pivotal movement between an extended position in which a portion of the first catch member extends out of the cavity on one side of the latch pin and a retracted position in which substantially no portion of the first catch member extends out of the cavity, and a second catch member also mounted in the cavity of the latch pin for pivotal movement between an extended position in which a portion of the second catch member extends out of the cavity on the side of the latch pin substantially opposite the side from which the first catch member extends in its extended position, and a retracted position in which substantially no portion of the second catch member extend out of the cavity.

4. The releasable mount of claim 3 wherein the retraction biasing means includes:

a ball mounted in the cavity of the latch pin and being adapted to contact a ball-receiving curved portion of each catch member when the catch members are in their retracted position, and a biasing spring for biasing the ball against the ball-receiving curved portion of each catch member, whereby when the catch members are in their retracted position, the ball contacts the ball-receiving curved portion of each catch member, thereby helping to prevent the ball from falling out or letting the catch members open.

5. The releasable mount of claim 1 including a latch pin housing having a base member extending substantially transversely from the latch pin and adapted to substantially cover the open end of the fixed housing when the latch pin is in the latched position.

6. The releasable mount of claim 5 wherein the latch pin housing includes an overlapping housing portion connected to the base member that is adapted to overlap somewhat with the fixed housing near the fixed housing open end when the latch pin is in the latched position and to thereby substantially seal the fixed housing together with the latch pin housing.

7. The releasable mount of claim 5 including separation biasing means for providing separation energy to separate the latch pin from the fixed housing when the trigger pin is moved to the release position.

8. The releasable mount of claim 7 wherein the separation biasing means includes a spring adapted to compress between the base member of the latch pin housing and the latch member, when the latch pin is inserted to the latched position, the energy stored in the compressed spring being the separation energy.

9. The releasable mount of claim 1 wherein the remote actuating means includes a cable connected to the trigger pin and adapted to extend through the wall and into the inside of the building.

10. The releasable mount of claim 9 wherein the remote actuating means also includes a kick plate assembly mounted on the inside surface of the wall near the floor of the building, the cable being connected to the kick plate, for enabling the cable to be pulled a sufficient distance to move the trigger pin from the cocked position to the release position in response to a pushing force applied to the kick plate assembly.

11. The releasable mount of claim 10 wherein the kick plate assembly includes:

a kick plate housing and mount adapted to be rigidly secured to the inside surface of the wall, and a kick plate, pivotally mounted on the mount for movement between a substantially vertical cocked position and a release position pivoted toward the wall, the cable being connected to the kick plate, so that when the kick plate moves from the substantially vertical cocked position to the release position, the cable is pulled a sufficient distance to move the trigger pin from the trigger pin cocked position to the trigger pin release position.

12. A releasable mount for mounting a window grille over a window, the mount comprising:

a fixed housing having a base end adapted for rigid attachment to a wall adjacent to the window, and an open end directed outwardly away from the wall, a latch member mounted inside the fixed housing, the latch member having an opening therethrough, a latch pin adapted to be rigidly connected to the window grille, and adapted to be received through the open end of the fixed housing and the opening in the latch member, to a latched position, the grille being in the desired mounted position over the window when the latch pin is in the latched position, a latch pin housing connected to the latch pin, said housing being adapted to overlap with the open end of the fixed housing when the latch pin is in the latched position for substantially sealing the fixed housing, a pair of catch members mounted in a cavity that extends through the latch pin, the catch members being adapted for pivoting movement between a retracted position in which the catch members are contained substantially in the latch pin cavity so that the latch pin may be inserted and withdrawn from the fixed housing through the latch member opeing, and an expanded position, when the latch pin is in the latched position, in which expanded position the catch members extend from opposite sides of the latch pin, in position to catch on the latch member so that the latch pin may not be withdrawn from the latched position, a trigger pin mounted in the fixed housing with one end extending between the base end of the fixed housing and the latch member, the trigger pin being adapted for movement between a cocked position, and a release position relatively further away from the latch member, and being biased by a biasing means in the cocked position, the trigger pin, when in the cocked position, being adapted to contact the catch members mounted on the latch pin when the latch pin is inserted into the fixed housing to the latched position, said contact causing the catch members to expand to the expanded position, and, the trigger pin, when in the release position, being adapted to enable the catch members to retract to the retracted position so that the latch pin may be withdrawn from the fixed housing, and remote actuating means connected to the trigger pin for enabling a person inside the building to move the trigger pin from the cocked position to the release position, thereby enabling the latch pin to be withdrawn from the latched position.

13. The releasable mount of claim 12 wherein the catch members are mounted for pivoting movement on a pivot pin, connected to the latch pin, and extending transversely through the longitudinal centerline of the latch pin.

14. The releasable mount of claim 13 wherein each catch member includes a rounded outer end adapted to contact the trigger pin when the latch pin is inserted to the latched position, said rounded outer end enabling the catch member to pivot outwardly to the expanded position in response to said contact with the trigger pin.

15. The releasable mount of claim 14 including:

a ball mounted in the latch pin cavity, the ball being adapted to contact a ball-receiving, concavely curved, end of each catch member when the catch members are in their retracted position, said ball-receiving end being opposite the rounded outer end, and a biasing spring for biasing the ball against the ball-receiving curved end of each catch member, whereby when the catch members are in their retracted position, the ball contacts the ball-receiving curved end of each catch member, thereby helping to prevent the balls from falling out.

16. The releasable mount of claim 15 including a separating spring mounted in the latch pin housing, said spring being adapted to compress between the latch pin housing and the latch member when the latch pin is inserted to the latched position, the separatinq spring providing separating energy for enabling the latch pin and the fixed housing to separate from the latched position when the trigger pin is moved to the release position.

* * * * *